US010583954B2

(12) United States Patent
Stamoulis et al.

(10) Patent No.: US 10,583,954 B2
(45) Date of Patent: Mar. 10, 2020

(54) PACKAGING FOR A SHAVER AND RELATED METHODS OF USE

(71) Applicant: Bic Violex S.A., Anixi (GR)

(72) Inventors: Vasileios Stamoulis, Trikala (GR); Dionysios Klavdianos, Athens (GR); Emmanouil Komianidis, Athens (GR); Aristeidis Stathis, Athens (GR); Andreas Vasiliadis, Athens (GR)

(73) Assignee: Bic Violex S.A., Anixi (GR)

( * ) Notice: Subject to any disclaimer, the term of this patent is extended or adjusted under 35 U.S.C. 154(b) by 0 days.

(21) Appl. No.: 15/923,314

(22) Filed: Mar. 16, 2018

(65) Prior Publication Data

US 2019/0283921 A1 Sep. 19, 2019

(51) Int. Cl.

| | |
|---|---|
| ***B65D 5/38*** | (2006.01) |
| ***B65D 25/10*** | (2006.01) |
| ***A45C 11/24*** | (2006.01) |

(52) U.S. Cl.

CPC ..... *B65D 5/38* (2013.01); *A45C 11/24* (2013.01); *B65D 25/10* (2013.01); *B65D 2203/00* (2013.01)

(58) Field of Classification Search

CPC ..... B65D 5/38; B65D 5/4216; B65D 5/4212; B65D 25/10; A45C 11/24

USPC ..... 206/352, 39.5, 39.4, 459.5

See application file for complete search history.

(56) References Cited

U.S. PATENT DOCUMENTS

| | | | | |
|---|---|---|---|---|
| 6,105,784 | A * | 8/2000 | Salminen | B65D 5/5088 206/1.5 |
| 2012/0193903 | A1* | 8/2012 | Boyer | G09F 23/00 283/67 |
| 2015/0314466 | A1* | 11/2015 | Papadopoulos-Papageorgis | B26B 21/222 30/532 |

* cited by examiner

*Primary Examiner* — King M Chu

(74) *Attorney, Agent, or Firm* — Bookoff McAndrews, PLLC

(57) ABSTRACT

A packaging for a shaver may include a shell configured to shift between a closed configuration and an open configuration, wherein the shell is configured to receive the shaver. The packaging may also include an image of the shaver disposed on an outer surface of the shell, and an actuator coupled to the outer surface of shell, the actuator being disposed within the image of the shaver, and wherein activation of the actuator while the shell is in the closed configuration, causes the shell to shift from the closed configuration to the open configuration.

18 Claims, 12 Drawing Sheets

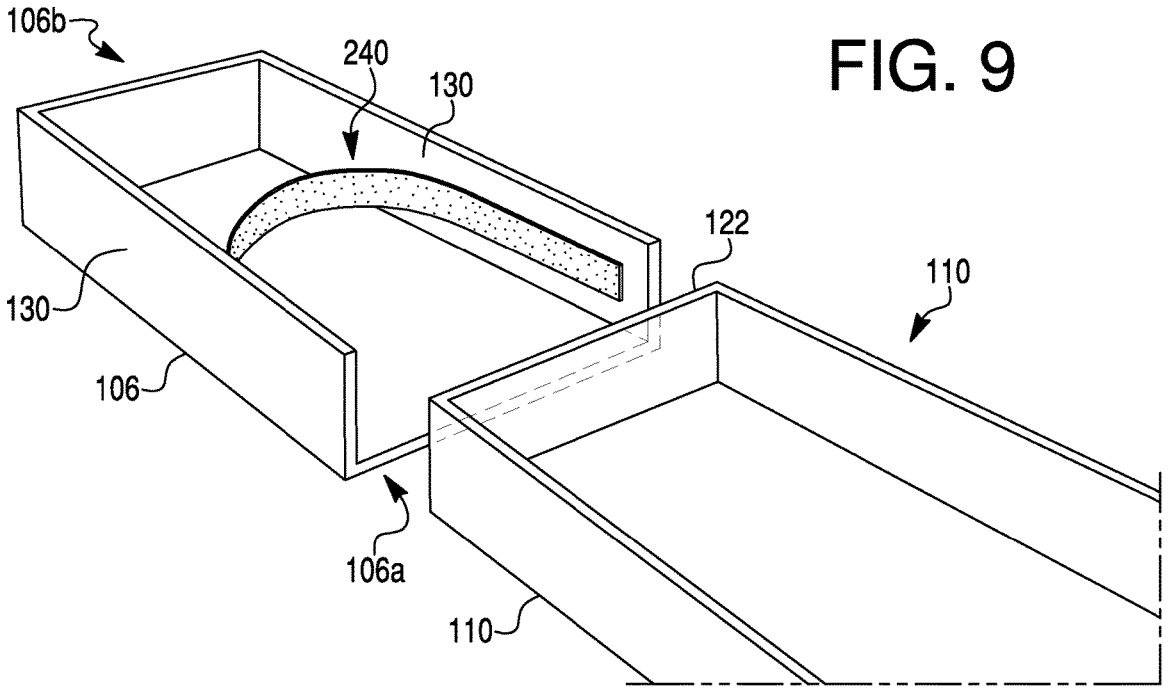
FIG. 9
FIG. 10
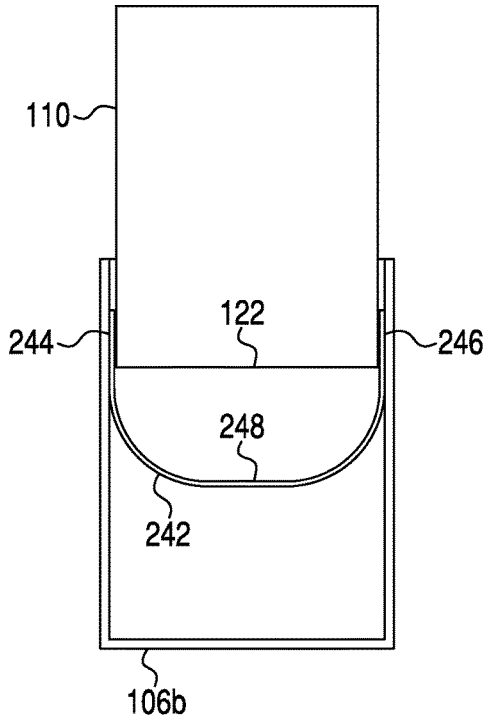
FIG. 11
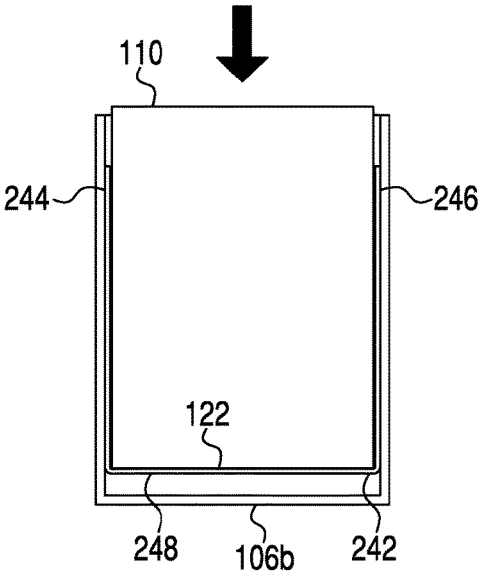

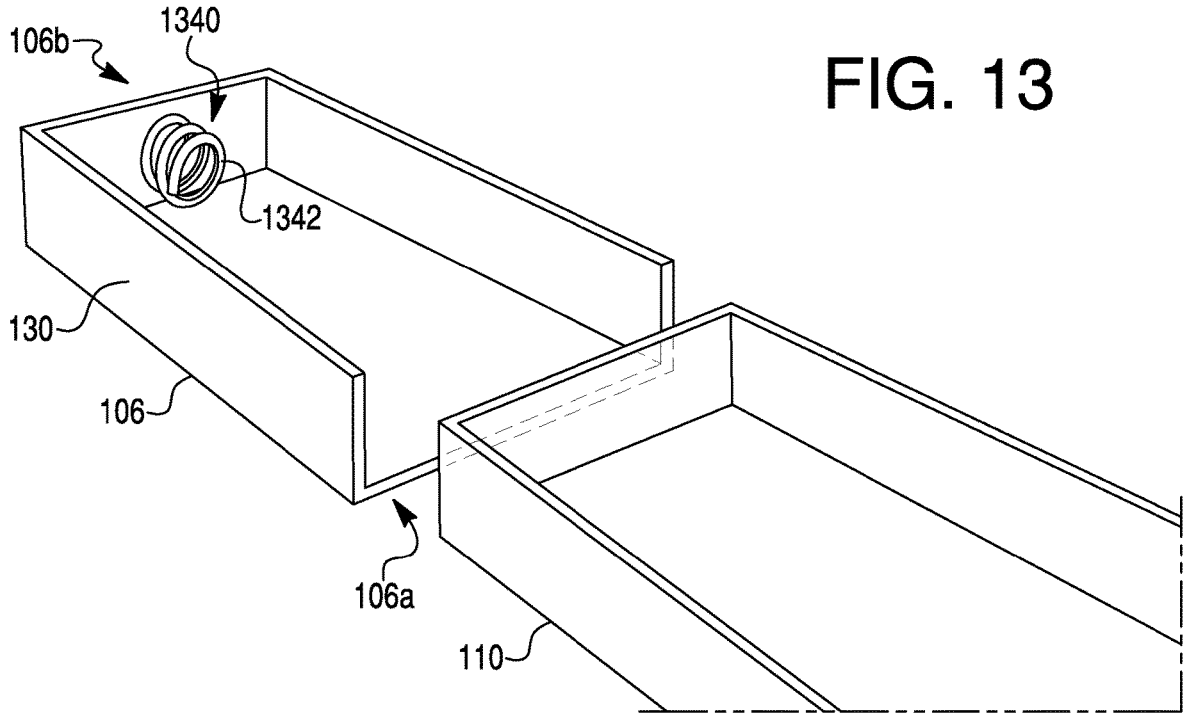
FIG. 13
FIG. 14
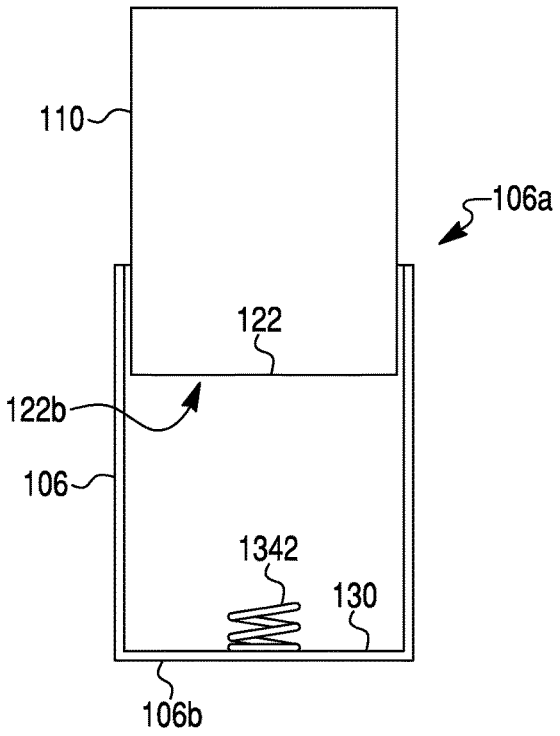
FIG. 15
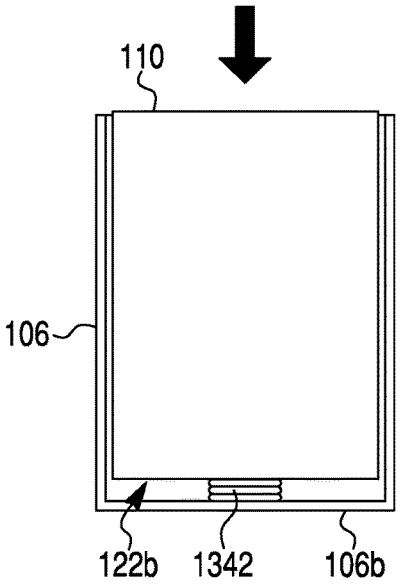

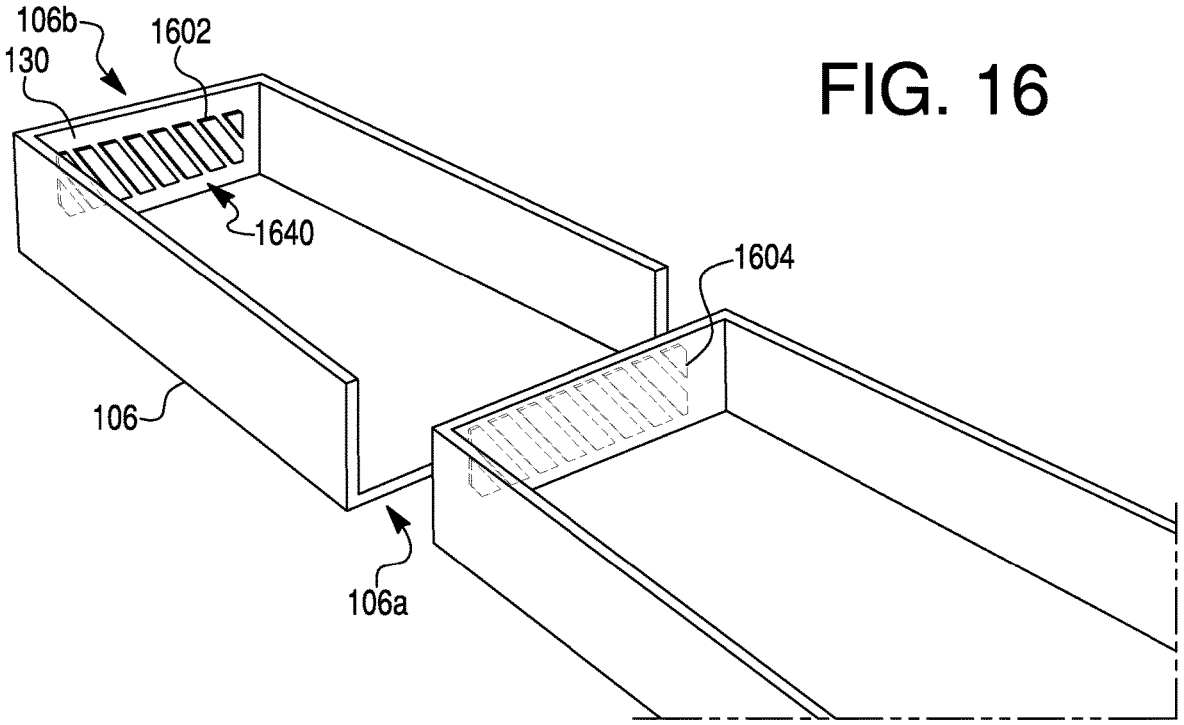
FIG. 16
FIG. 17
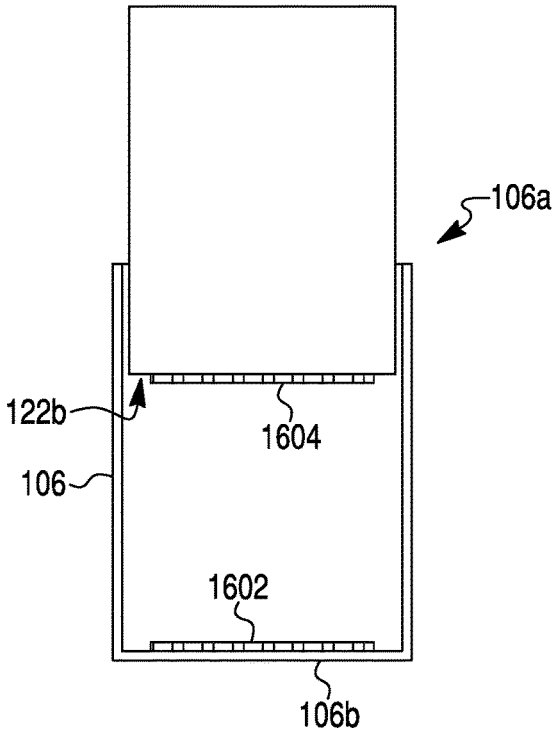
FIG. 18
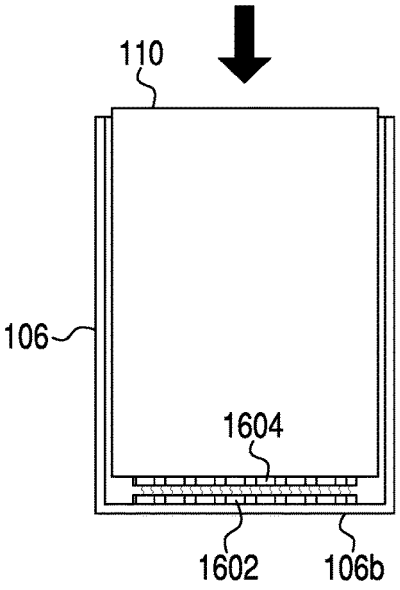

PACKAGING FOR A SHAVER AND RELATED METHODS OF USE

TECHNICAL FIELD

Aspects of the present disclosure relate generally to packaging for shavers, and, specifically, to examples of packages having user-friendly, intuitive designs.

DESCRIPTION OF RELATED TECHNOLOGY

In typical shaver packaging, a user must tear and/or destroy the package to access the shaver, which can be frustrating and wasteful.

Both the foregoing general description and the following detailed description are exemplary and explanatory only and are not restrictive of the features, as claimed. As used herein, the terms "comprises," "comprising," or other variations thereof, are intended to cover a non-exclusive inclusion such that a process, method, article, or apparatus that comprises a list of elements does not include only those elements, but may include other elements not expressly listed or inherent to such a process, method, article, or apparatus. Additionally, the term "exemplary" is used herein in the sense of "example," rather than "ideal." It should be noted that all numeric values disclosed or claimed herein (including all disclosed values, limits, and ranges) may have a variation of +/−10% (unless a different variation is specified) from the disclosed numeric value. Moreover, in the claims, values, limits, and/or ranges mean the value, limit, and/or range +/−10%. As used herein, the terms "about," "substantially," and "approximately," indicate a range of values within +/−10% of the stated value. Furthermore, the term "about equal" used to compare different values may mean that the values are within +/−10% of one another.

SUMMARY

In one aspect, the present disclosure is directed to a packaging for a shaving system that includes a shell configured to shift between a closed configuration and an open configuration, wherein the shell is configured to receive a shaver. The packaging may also include an image of the shaver disposed on an outer surface of the shell, and an actuator coupled to and extending from the outer surface of shell, the actuator being disposed within the image of the shaver, and wherein activation of the actuator while the shell is in the closed configuration, causes the shell to shift from the closed configuration to the open configuration.

The packaging may include a biasing mechanism configured to bias the shell into the open configuration. The actuator may include a sphere extending away from the outer surface of the shell, a spherical cap extending away from the outer surface of the shell, or a button having a top surface that is flush with the outer surface of the shell. The packaging may include a drawer disposed within the shell, wherein: the shell includes a first enclosure and a second enclosure that are movable relative to one another; the first enclosure and the second enclosure directly contact one another in the closed configuration; and the first enclosure and the second enclosure do not directly contact one another and are connected to one another via the drawer in the open configuration. The drawer may be fixed to the first enclosure, and movable relative to the second enclosure. The packaging may include a stop configured to abut a sidewall of the drawer to prevent the drawer from separating from the second enclosure in the open configuration. The packaging may include a biasing mechanism configured to bias the shell into the open configuration, wherein: the stop is configured to abut an interior side of the sidewall of the drawer; an exterior side of the sidewall of the drawer pushes against the biasing mechanism in the closed configuration; the stop is part of a first engagement mechanism coupled to a surface of the first enclosure; the packaging further including a second engagement mechanism coupled to a surface of the second enclosure; and the first engagement mechanism and the second engagement mechanism are interlocked with one another in the closed configuration. The second enclosure may include opposing sidewalls, and the system may further include a biasing mechanism with a band coupled at first and second ends to opposing sidewalls of the second enclosure, wherein: in the closed configuration, the drawer pushes against the band, causing the band to be taut; and in the open configuration, the band is slack. The second enclosure may extend from a closed end to an open end, the drawer being slidable through the open end, and the packaging further includes a biasing mechanism including a spring attached to the closed end of the second enclosure, the spring being extended in the open configuration, and configured to be compressed by the drawer in the closed configuration. The second enclosure may extend from a closed end to an open end, the drawer being slidable through the open end, and the packaging further includes a biasing mechanism including a first magnet coupled to the closed end of the second enclosure, and a second magnet coupled to the drawer, wherein like poles of the first magnet and the second magnet face one another. The image of the shaver may include a cartridge image disposed on first enclosure. The shaver may include a handle having a button, and a cartridge having one or more blades, the cartridge being configured to releasably couple to the handle, wherein, when the button is pressed while the cartridge is coupled to the handle, the cartridge is uncoupled from the handle. The image of the shaver may include a handle image having a proximal end and a distal end, and a distance from a center of the actuator to the proximal end of the handle image is about equal to a distance from a center of the button to a proximal end of the handle, said image being disposed on second enclosure. The actuator and the button may have about equal dimensions, and/or substantially similar visual appearances and tactile feels. The packaging may include a pair of engagement members that interlock with one another to maintain the shell in the closed configuration, wherein activation of the actuator causes one of the pair of engagement members release from the interlock. The packaging may include a tray contained within the shell, the tray including a plurality of storage compartments.

In another aspect, the disclosure is directed to a package, comprising a shell configured to shift between a closed configuration and an open configuration, an image of a shaver disposed on an outer surface of the shell, an actuator coupled to the outer surface of shell, the actuator being disposed within the image of the shaver, and activation of the actuator while the shell is in the closed configuration, causes the shell to shift from the closed configuration to the open configuration, and a shaver having a handle, a cartridge having one or more blades, the cartridge being releasably coupled to the handle, and a button that, when pressed while the cartridge is coupled to the handle, releases the cartridge from the handle, wherein a length of the image of the shaver is about equal to a length of the shaver.

A diameter of the actuator may be about equal to a diameter of the button, and the actuator and the button are formed from the same material. In some aspects, the actuator and the button may be formed from different materials (e.g., plastic, metal, or combinations thereof).

In yet another aspect, the present disclosure is directed to a method of instructing a user to use a shaving system, the shaving system comprising a shell and a shaver within the shell, the shell being configured to shift between a closed configuration and an open configuration, the shaver including a handle, a cartridge containing one or more blades, and a first actuator for releasing the cartridge from the handle, the method comprising: providing, on an outer surface of the shell, an image of the shaver and a second actuator coupled to the outer surface of the shell, the second actuator being disposed within the image of the shaver, wherein activation of the second actuator, while the shell is in the closed configuration, causes the shell to shift from the closed configuration to the open configuration.

The method may further include providing the shaver within the shell.

BRIEF DESCRIPTION OF THE DRAWINGS

The accompanying drawings, which are incorporated in and constitute a part of this disclosure, illustrate various exemplary embodiments and together with the description, serve to explain the principles of the disclosure.

Aspects of the disclosure may be implemented in connection with embodiments illustrated in the attached drawings. These drawings show different aspects of the present disclosure and, where appropriate, reference numerals illustrating like structures, components, materials and/or elements in different figures are labeled similarly. It is understood that various combinations of the structures, components, and/or elements, other than those specifically shown, are contemplated and are within the scope of the present disclosure. There are many aspects and embodiments described herein. Those of ordinary skill in the art will readily recognize that the features of a particular aspect or embodiment may be used in conjunction with the features of any or all of the other aspects or embodiments described in this disclosure.

FIG. 9 is a partial, perspective cut-away view of the packaging of FIG. 1 and a biasing mechanism.

FIGS. 10 and 11 are partial top views of the packaging of FIG. 1 and the biasing mechanism of the embodiment depicted in FIG. 9.

FIG. 13 is a partial, perspective cut-away view of the packaging of FIG. 1 and an alternative biasing mechanism.

FIGS. 14 and 15 are partial top views of the packaging of FIG. 1 and the biasing mechanism of the embodiment depicted in FIG. 13.

FIG. 16 is a partial, perspective cut-away view of the packaging of FIG. 1 and yet another alternative biasing mechanism.

FIGS. 17 and 18 are partial top views of the packaging of FIG. 1 and the biasing mechanism of the embodiment depicted in FIG. 16.

DETAILED DESCRIPTION

Examples of the present disclosure are related to a packaging for shavers, wherein the packaging includes an opening and closing mechanism that imitates how a handle of the shaver releases a cartridge attached to the handle. The opening and closing mechanism may imitate the release of a cartridge from the shaver handle by using a similar actuator (e.g., a button or other suitable actuator) as the cartridge release mechanism. Examples of the present disclosure also enable the packaging to be opened by application of pressure by a user (e.g., by the user's finger), in a manner that does not require excess power or skills. It is therefore possible for a user to open the packaging either using one hand or both hands.

Figure 1A:
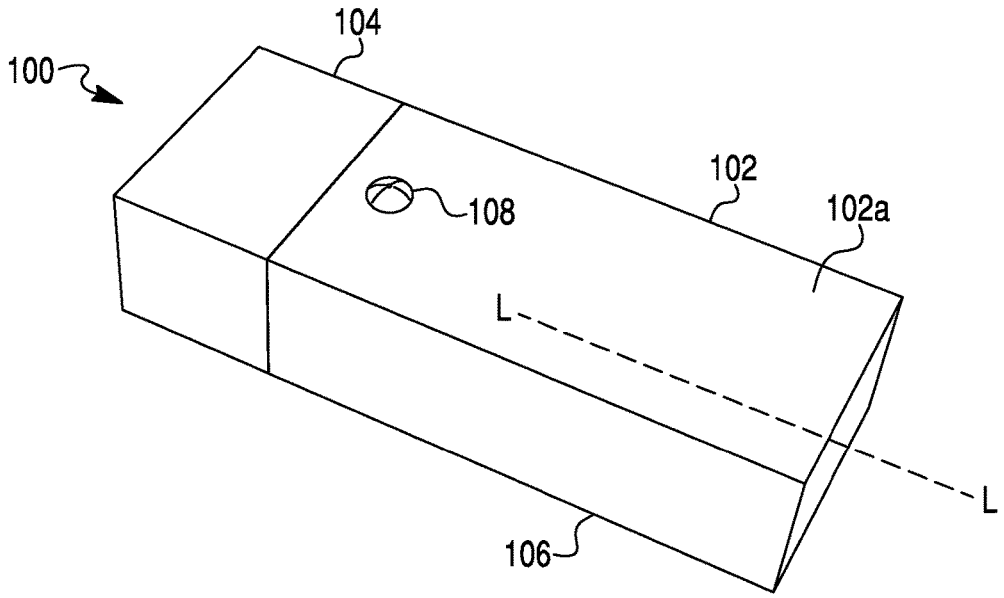
FIGS. 1A and 1B are perspective views of a packaging for a shaver in a closed configuration and an open configuration (e.g., completely, substantially, or partially open configuration), respectively.
Figure 1B:
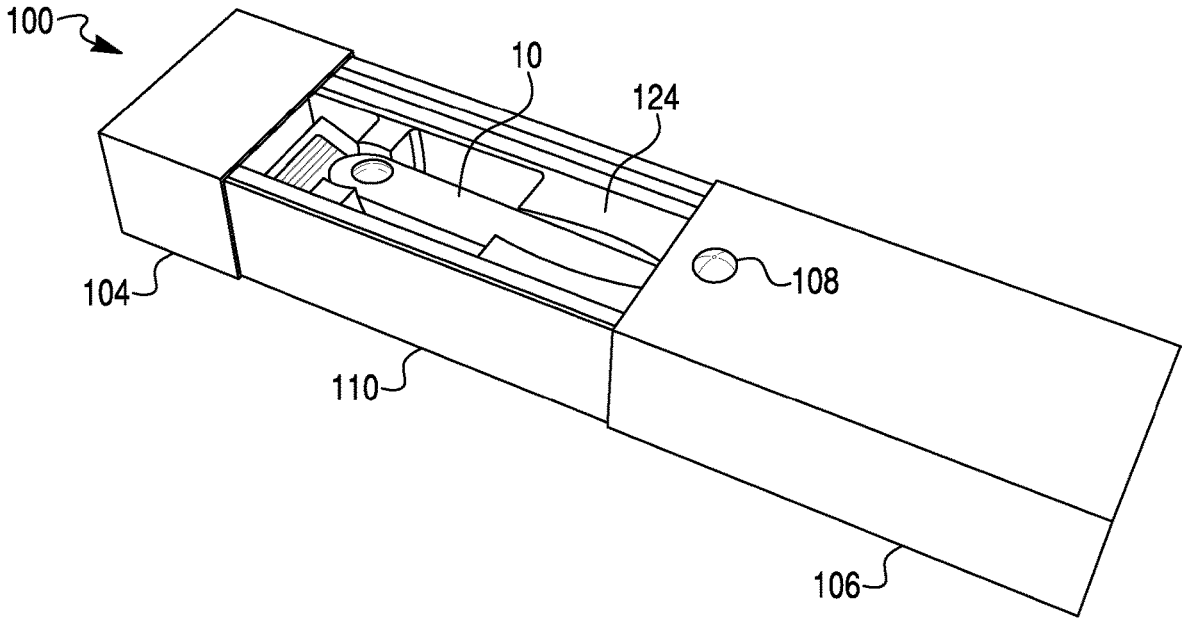

FIGS. 1A and 1B illustrate a packaging 100 in closed and open configurations, respectively. As alluded to above, packaging 100 may be configured to contain, hold, or otherwise store a shaver. Packaging 100 may include an outer shell 102 having a first enclosure 104 and a second enclosure 106. An actuator, e.g., a release button 108 (described in further detail below), may protrude outwardly from a first or top surface 102*a* of shell 102, and in particular, from a top surface of second enclosure 106. In yet other examples, a top surface of release button 108 may be flush or recessed relative to top surface 102*a*. First enclosure 104 and second enclosure 106 may have substantially similar height and width dimensions, but may have different length dimensions as shown. For example, second enclosure 106 may have a significantly longer length (e.g., along axis L-L) than first enclosure 104, although in alternative embodiments, the lengths may be the same, or first enclosure 104 may have a longer length than second enclosure 106. In the example shown, outer shell 102 may be a rectangular box, although other suitable shapes also are contemplated.

As shown in FIG. 1B, first enclosure 104 and second enclosure 106 may slide or otherwise move away from one another to expose a drawer 110, a tray 124, and a shaver 10 (when shaver 10 is stored within packaging 100), in the open configuration. In some examples, first enclosure 104, second enclosure 106, and drawer 110 may be formed from paper material (e.g., cardboard), and may be folded and/or glued together prior to assembly. In one example, first enclosure 104 and drawer 110 are fixed to one another, via, e.g., glue or another suitable adhesive, and may be movable relative to second enclosure 106. First enclosure 104 and second enclosure 106 may directly contact one another in the closed configuration of FIG. 1A and may not directly contact one another in the open configuration of FIG. 1B. First enclosure 104 and second enclosure 106 may still be indirectly connected to one another in the open configuration via drawer 110. First enclosure 104, second enclosure 106, and drawer 110 each may be formed from die-cuts, which are folded into a structural element with an adhesive agent (e.g., glue) or with interlocking die-cut features. In other embodiments, first enclosure 104, second enclosure 106, and/or drawer 110 may be formed from, e.g., plastic, via a suitable molding process. Tray 124 may function as an impact absorber, and thus, may protect the contents of packaging 100 from impact and/or movement during shipping, transportation, and storage. Moreover, while in the closed configuration, packaging 100 may protect its contents from environmental contamination (e.g., dust).

Figure 2A:
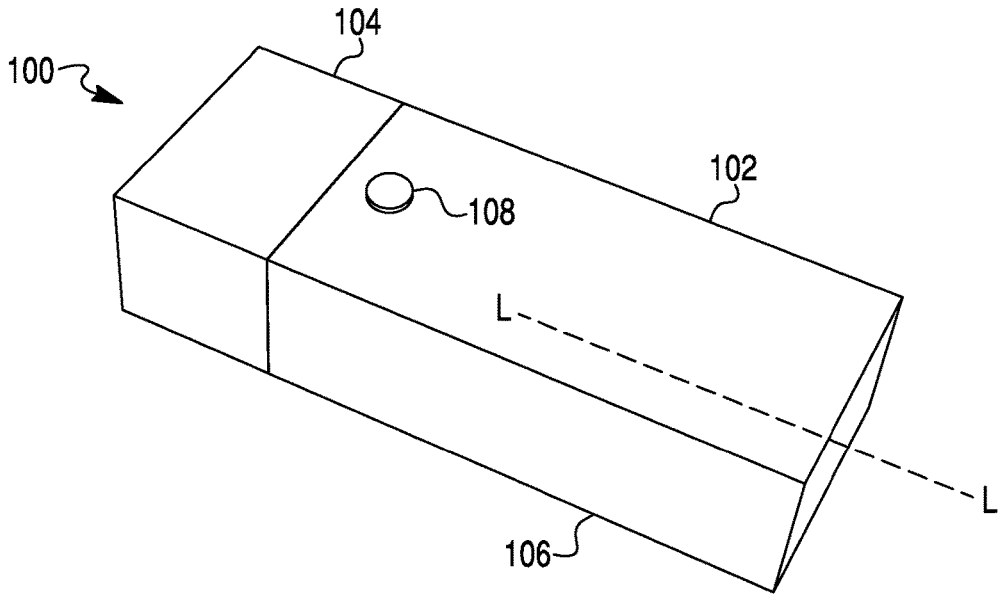
FIGS. 2A and 2B are perspective views of another embodiment of a packaging for a shaver in a closed configuration and an open configuration (e.g., completely, substantially, or partially open configuration), respectively.
Figure 2B:
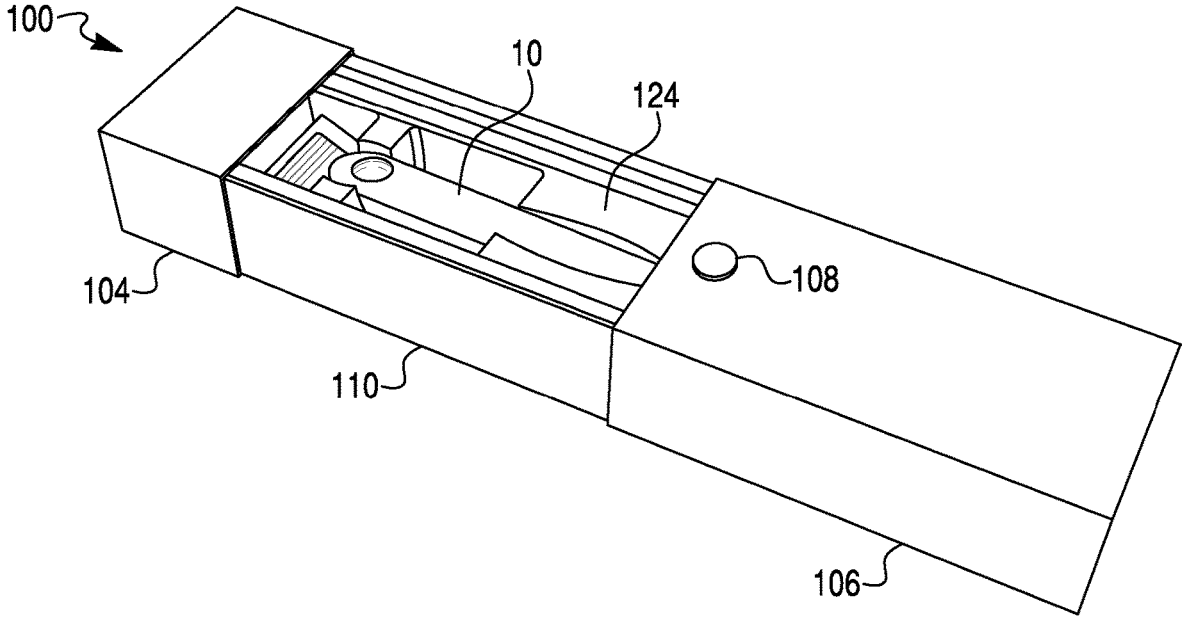

FIGS. 2A and 2B illustrate an alternative embodiment of packaging 100. In FIGS. 2A and 2B, release button 108 (described in further detail below) has a different geometric shape (e.g., is flatter) than in FIGS. 1A and 1B. In this embodiment, release button 108 may be a spherical cap having a flat or planar top surface. In other examples, release button 108 may be substantially cylindrical such that the portion of release button 108 that protrudes from top surface 102*a* resembles a disk or puck.

Figure 3A:
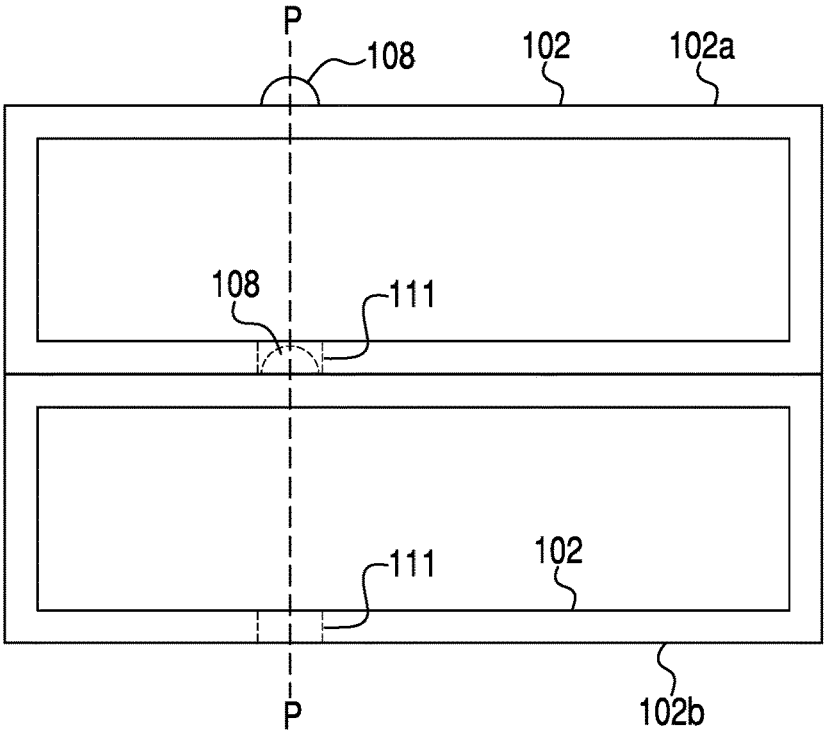
FIGS. 3A and 3B are side views of embodiments of packaging for shavers, in stacked configurations.
Figure 3B:
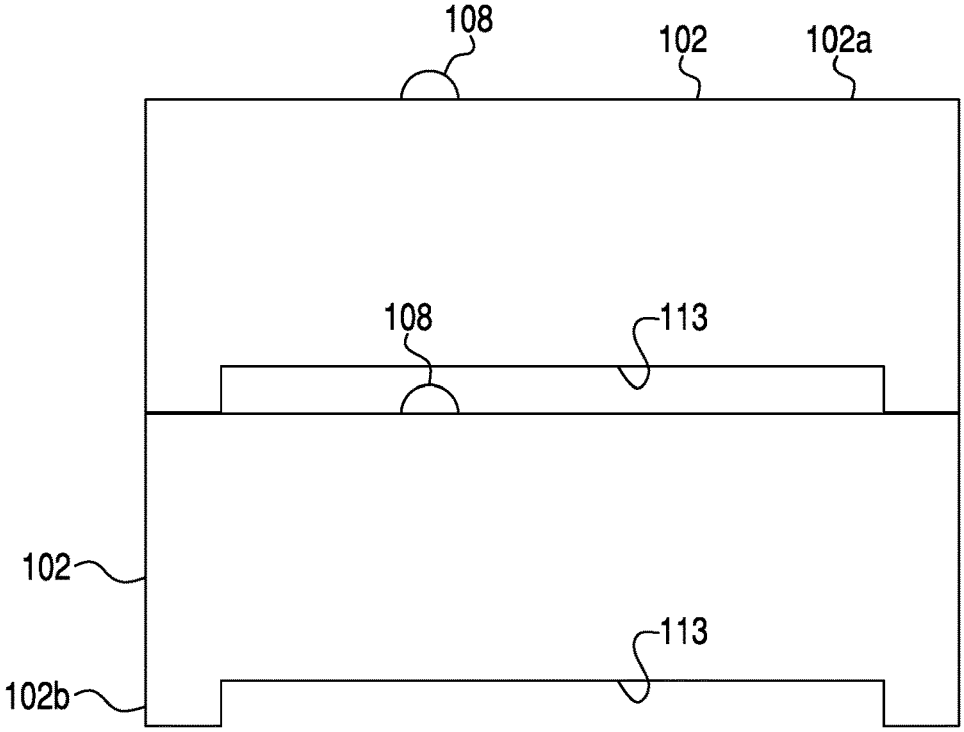

Referring now to FIGS. 3A and 3B, shell 102 may include a recess 111 or cavity 113 disposed in a second or bottom surface 102*b* of shell 102 to facilitate stacking of multiple shells 102 without pressing release button 108. For example, recess 111 may be sized and configured to receive a release button 108 from an adjacent shell 102 when multiple shells 102 are stacked on one another. A longitudinal center of recess 111 and a longitudinal center of release button 108 both may lie in a plane P-P that is perpendicular to longitudinal axis L-L. Recess 111 may have a slightly greater length (along axis L-L), and also a greater height and width than release button 108. In another embodiment, cavity 113 may receive a release button 108 from an adjacent packaging 100. Like recess 111, cavity 113 may have a greater length (along axis L-L), and a greater width and height than release button 108. Cavity 113 may extend along more than 50%, more than 75%, or more than 90% of the length of shell 102 (along axis L-L) so that multiple shells 102 can be stacked regardless of radial orientation. That is, in the embodiment of FIG. 3A, first enclosures 104 of adjacent shells 102 must be aligned with one another for a release button 108 to be received in the recess 111 of an adjacent shell 102. However, in the embodiment of FIG. 3B, due to the extended length of cavity 113, first enclosures 104 of a given shell 102 can be aligned with either the first enclosure 104 or the second enclosure 106 of an adjacent shell 102 when being stacked.

Figure 5B:
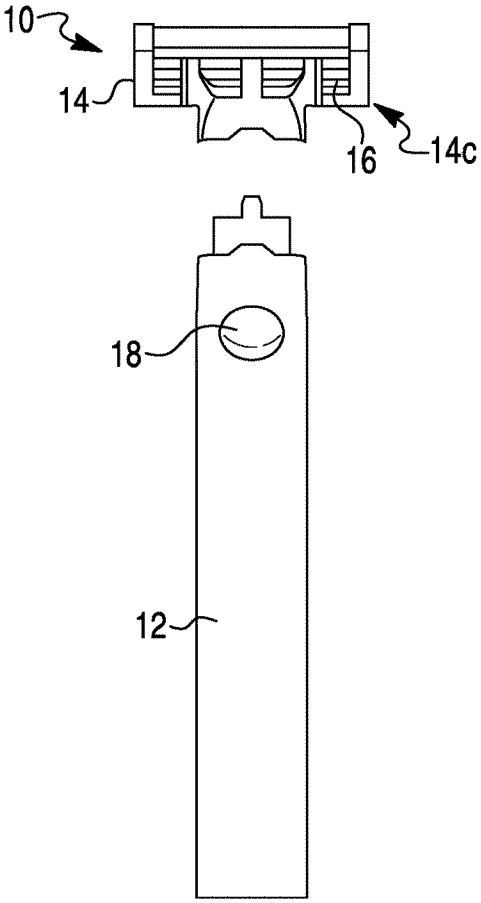
FIG. 5B is an exploded top view of the shaver of FIG. 5A, wherein the cartridge is separated from a handle.
Figure 5A:
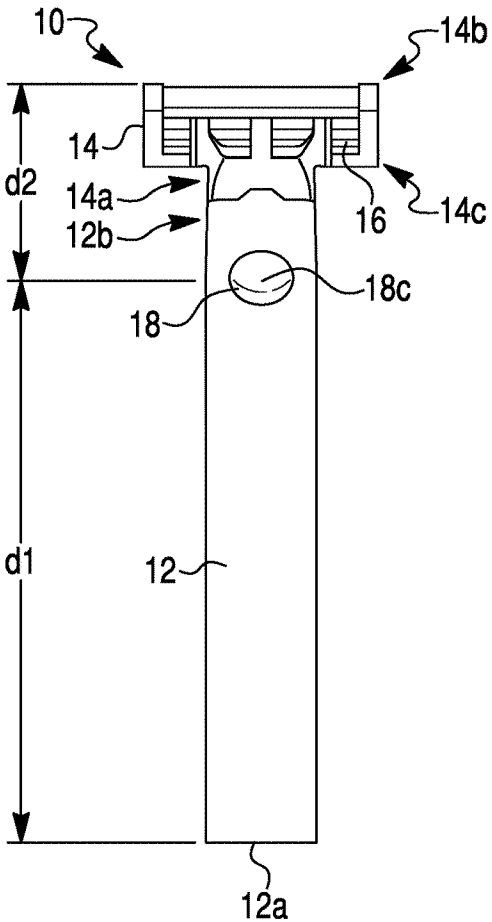
FIG. 5A is a top view of a shaver, including a cartridge secured to a handle.
Figure 4:
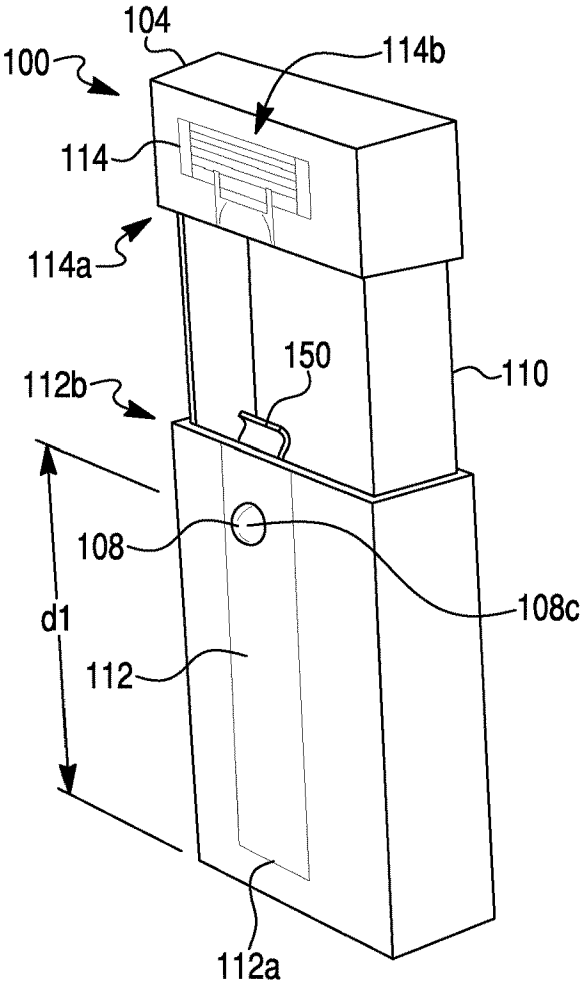
FIG. 4 is a perspective view of a portion of the packaging in FIG. 1 in a partially open configuration.

Referring now to FIGS. 4, 5A, and, 5B, outer surfaces of shell 102 may comprise images, decals, drawings, or the like, that resemble the shaver 10 housed within packaging 100. Shaver 10 may include a handle 12, a cartridge 14 having one or more blades 16, and a release button 18. Release button 18 may be configured to cause releasable cartridge 14 to decouple from handle 12 by any suitable mechanism. A handle image 112 may be disposed on second enclosure 106, while a cartridge image 114 may be disposed on first enclosure 104. Handle image 112 and cartridge image 114 may include identical or substantially similar dimensions, coloring, and/or appearance, as handle 12 and cartridge 14, such that when packaging 100 is in the closed configuration, handle image 112 and cartridge image 114 resemble an assembled shaver 10, thereby serving to inform a user of the contents of packaging 100 even when packaging 100 is in the closed configuration. Handle image 112 and cartridge image 114 may also resemble a decoupled shaver 10 (e.g., handle 12 and cartridge 14) when packaging 100 is in the open configuration. Furthermore, release button 108 may be positioned inside of handle image 112 in a corresponding location as release button 18 within or on handle 12.

Handle 12 may extend from a proximal end 12*a* to a distal end 12*b*. Proximal end 12*a* may be the end that the user grips and holds while shaving, while distal end 12*b* may be the end of handle 12 that is furthest from the end being held (and the end closed to the skin being shaved). A proximal end 14*c* of cartridge 14 may include an interconnecting member 14*a* that may be releasably coupled to distal end 12*b* of handle 12, and cartridge 14 may extend from proximal end 14*c* to a distal end 14*b*. Handle image 112 and cartridge image 114 may also include respective proximal ends 112*a* and 114*a*, and respective distal ends 112*b* and 114*b*. As set forth above, the arrangement of handle image 112, cartridge image 114, and release button 108 may be designed to give an exact or nearly exact visual impression of shaver 10 when viewed from above. Thus, a distance (d1, referring to FIGS. 4 and 5A) between a center 18*c* of release button 18 and proximal end 12*a* of handle 12 may be the same, equal, or about equal, to a distance d1 between a center 108*c* of release button 108 and proximal end 112*a* of handle image 112, while packaging 100 is in the closed configuration. Similarly, a distance (d2, shown only in FIG. 5A) between a center 18*c* of release button 18 and distal end 14*b* of cartridge 14 may be the same, equal, or about equal, to a distance d2 between a center 108*c* of release button 108 and distal end 114*b* of cartridge image 114, while packaging 100 is in the closed configuration. Furthermore, release button 108 and release button 18 may have same, equal, or about equal diameters, and may be formed of the same or substantially the same materials to give the user a similar tactile feel. For example, release button 108 may imitate the shape, volume, and/or proportions of release button 18. In some embodiments, release button 108 may have a flat or substantially flat surface that is parallel to top surface 102*a* and bottom surface 102*b* of shell 102. In some aspects, release button 108 and release button 18 may be formed of different materials (e.g., metal and plastic), and may have a similar visual appearance and/or tactile feel to one another. For example, release button 108 may be formed from plastic and have a metallic appearance, and release button 18 may be formed from a metal.

Release button 108 may be biased away from a surface of packaging 100 in a manner similar to how release button 18 may be biased away from handle 12. Additionally, images of handle image 112, release button 108, and cartridge image 114, taken while packaging 100 is in the closed configuration and on a flat surface, and from a vantage point directly above packaging 100, may be indistinguishable or nearly indistinguishable from images of an assembled shaver 10 (also taken on a flat surface from the same vantage point).

Handle image 112 and cartridge image 114 may be applied to the outer surfaces of packaging 100 by embossing, engraving, or another suitable process. In some examples, an identifying and distinguishing feature of packaging 100 is the mechanism by which packaging 100 is opened (e.g., separation of first enclosure 104 from second enclosure 106, which mimics the release of cartridge 14 from handle 2. Further, the combination of the packaging graphics (handle image 112 and cartridge image 114), and the sliding mechanism, may predispose or otherwise suitably instruct a user with the actual product functionality, e.g., release of cartridge 14 from handle 12.

Figure 6A:
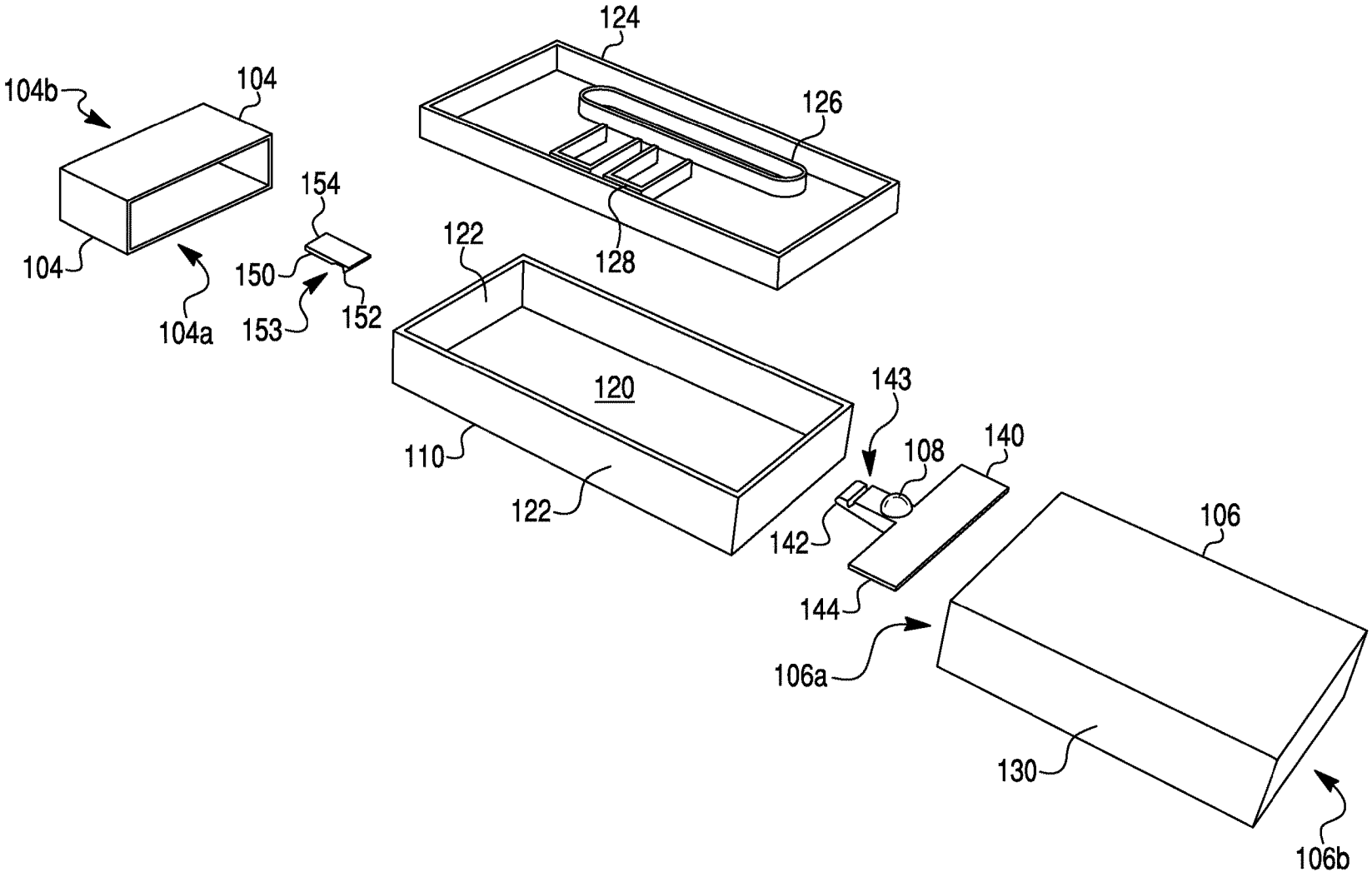
FIG. 6A is an exploded perspective view of the packaging of FIG. 1.

FIG. 6A is an exploded view of packaging 100. Drawer 110 may include a base surface 120 and one or more sidewalls 122 (e.g., a plurality of sidewalls 122) that extend perpendicular to base surface 120. Tray 124 may be received within a volume defined by base surface 120 and sidewalls 122, and may be formed from plastic, paper pulp, or any other suitable material. That is, tray 124 may be nested within drawer 110 such that no portion of tray 124 extends past a sidewall 122. Further, in some aspects, one or more sidewalls 122 may include one or more geometric features to permit first enclosure 104 and/or second enclosure 106 to reciprocally slide along drawer 110 toward and away from one another. For example, one or more sidewalls 122 may include a rail or track configured to receive a complementary peg, pin, or other projection extending from an inner surface of one or more of first enclosure 104 and/or second enclosure 106. In another aspect, one or more sidewalls 122 may include a peg, pin, or other projection extending away from a respective sidewall and configured to engage with a complementary rail or track on an inner surface of one or more of first enclosure 104 and/or second enclosure 106.

Tray 124 may include a shaver compartment 126 and one or more (e.g., a plurality of) cartridge compartments 128. Shaver compartment 126 may be configured to retain a shaver 10 and an attached cartridge 14 (and associated protective cover 702, referring to FIGS. 7 and 8), while cartridge compartments 128 each may be configured to retain at least one spare cartridge 14. In some embodiments, each cartridge compartment 128 may be configured to retain two or more spare cartridges. In some examples, cartridges may be provided with a protector comprising connection means, and each cartridge compartment 128 may be configured to retain two or more cartridges connected together. In one example, shaver compartment 126 may be configured to engage a handle 12 of a shaver via, e.g., a snap fit connection or other suitable friction-based engagement. In some embodiments, a releasable adhesive may be used to facilitate retaining handle 12 on or within shaver compartment 126. Tray 124 may include one or more finger accommodating cavities (not shown) configured to allow a user to reach under and grab handle 12 or cartridge 14.

Cartridge compartments 128 may be configured to engage respective cartridges 14 in one or more similar manners. Tray 124 may include additional compartments not shown in FIG. 6, including, but not limited to, compartments for power cords, batteries, circuity, shaving gel, shaving cream, disinfectant, gauze, and other miscellaneous storage needs. Such additional compartments may be closed via one-time or reusable covering, such as, e.g., a peel-away foil covering adhesively secured to one such additional compartment. In some examples, where packaging 100 includes charging capability, one or more portions of tray 124 (e.g., shaver compartment 126) may be outfitted with charging contacts to charge a battery or other power source within shaver 10. In some examples, packaging 100 may be configured for inductive and/or contactless charging. Through inductive charging, for example, an electromagnetic field generated outside of packaging 100 may be used to transfer energy between two objects via electromagnetic induction. In such a case, an interface inside packaging 100 may be configured to receive inductive charge to charge a power source within shaver 10. The same contacts may be used to download information from shaver 10 into a memory of packaging 100 (e.g., memory 1904 described in further detail below with reference to FIG. 19).

With reference to FIGS. 6A, 6B, 7, and 8, packaging 100 may also include a first engagement part 140 and a second engagement part 150. First engagement part 140 and second engagement part 150 may be formed by additive manufacturing, injection molding, or any other suitable process. In one example, first engagement part 140 and second engagement part 150 may be formed from a plastic configured to withstand repetitive stress. In another example, first engagement part 140 and second engagement part 150 may be formed from a metal or metal alloy. First engagement part 140 may be releasably coupled to second engagement part 150. This releasable interlocking relationship enables packaging 100 to reciprocally shift between the open and closed configurations shown in FIGS. 1A, 1B, 2A, and 2B. First engagement part 140 and second engagement part 150 may have any suitable corresponding features to facilitate a releasable interlocking relationship. In the examples shown and described herein, one or both of first engagement part 140 and second engagement part 150 may include a hook and recess. For example, first engagement part 140 may include a hook 142 and a recess 143, and second engagement part 150 may include a hook 152 and a recess 153. Recess 143 may be configured to receive hook 152, and recess 153 may be configured to receive hook 142. However, any other suitable shapes may be used in first engagement part 140 and second engagement part 150, including, but not limited to, pin and hole arrangements, sliding locks, rotating locks, and the like. First engagement part 140 may also include a flange 144 configured to attach to an inner surface of second enclosure 106 by an adhesive or other suitable attaching mechanism, and second engagement part 150 may include a flange 154 that attaches to an inner surface of first enclosure 104 by a substantially similar mechanism.

Figure 6B:
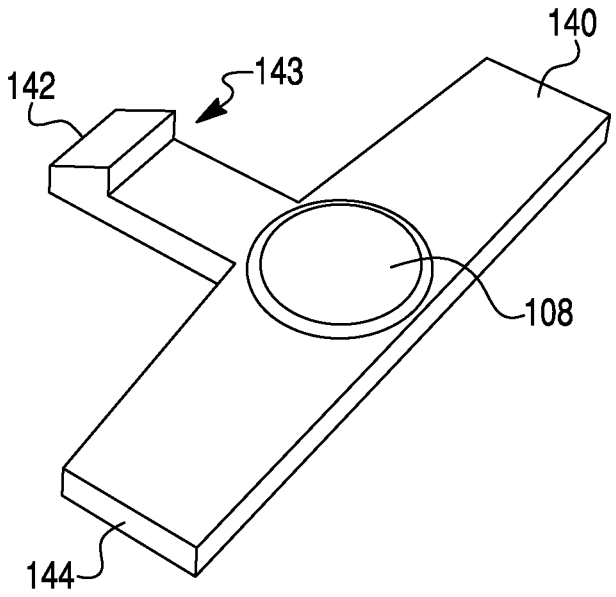
FIG. 6B is a perspective view of an alternative aspect of the packaging of FIG. 6A.

Release button 108 may be attached to, or otherwise integral with, first engagement part 140. In one example, release button 108 may be a sphere received by a recess 148 (referring to FIG. 7) of first engagement part 140. In other examples, release button 108 may be a half-sphere attached to a flat surface of first engagement part 140. In further examples, release button 108 may have any other size, shape, or configuration that is similar to a release button of a shaver suitable for storage inside packaging 100 (e.g., release button 18 on shaver 10). FIG. 6B depicts, for example, alternative shapes and configurations for first engagement part 140, including a release button 108 having a flat surface. In yet another example, release button 108 may be integrally formed with a remainder of first engagement part 140 (by, e.g., additive manufacturing or injection molding). An exposed portion of release button 108 (that is pressed by a user) may face a same direction as the opening of recess 143.

Figure 7:
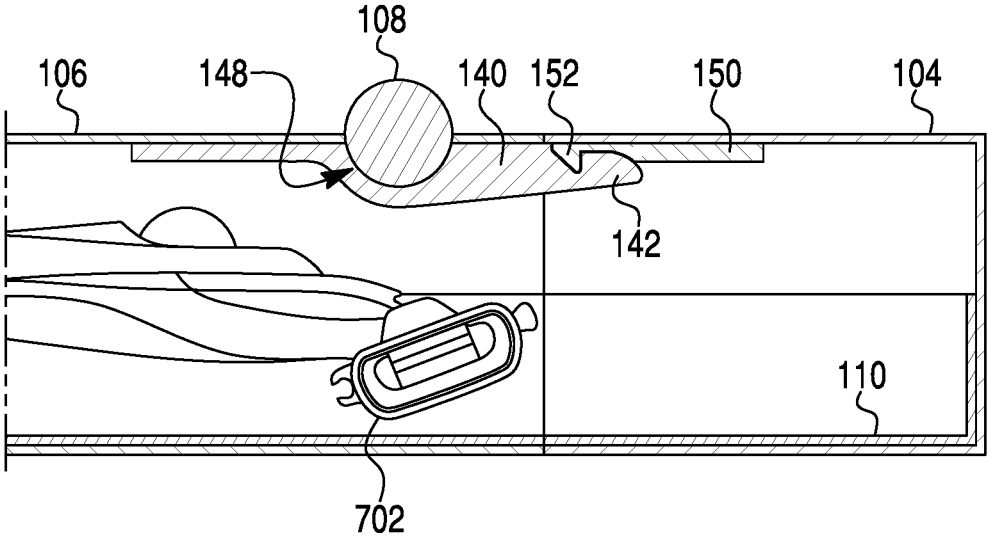
FIGS. 7 and 8 are partial side cross-sectional views of the packaging of FIG. 1.
Figure 8:
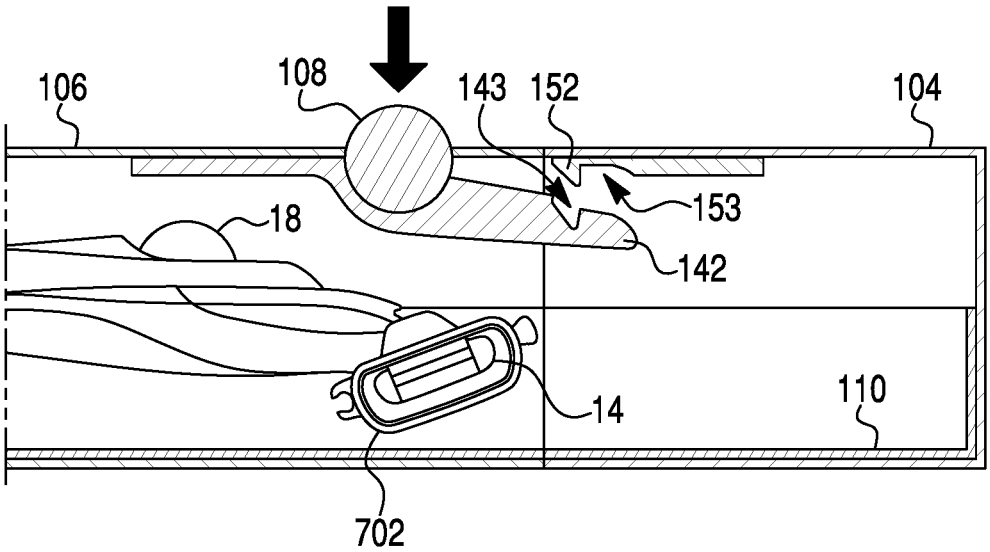

Referring now to FIGS. 7 and 8, the process and mechanism for transitioning packaging 100 from the closed configuration to the open configuration will be explained. FIG. 7 shows first engagement part 140 interlocked with second engagement part 150 while packaging 100 is in the closed configuration. To disengage first engagement part 140 from second engagement part 150, a user may apply a force against release button 108 to push first engagement part 140 away from second engagement part 150 and toward base surface 120 of drawer 110. This downward force may cause a portion of first engagement member (e.g., an end containing hook 142 and recess 143) to pivot toward base surface 120.

The disengagement shown in FIG. 8 may cause or otherwise allow first enclosure 104 and second enclosure 106 to move away from one another (e.g., by sliding into the open configuration of packaging 100). Referring to FIGS. 9-11, packaging 100 may be biased into the open configuration by a biasing mechanism 240. Biasing mechanism 240 may be any suitable mechanism now known or later developed. In one example, biasing mechanism may include an elastic band 242 extending from a first end 244 to a second end 246. First end 244 may be coupled to an inner surface of one sidewall 130 of second enclosure 106, and second end 246 may be coupled to an inner surface of another sidewall 130 of second enclosure 106. A middle portion 248 of elastic band 242 may be slack (see FIG. 10) when packaging 100 is in the open configuration, and elongated and taut (see FIG. 11) when packaging 100 is in the closed configuration. Thus, when packaging 100 is in the closed configuration, a sidewall 122 of drawer 110 (that is closest to closed end 106*b* of second enclosure 106) may push against middle portion 248 of elastic band 242, stretching elastic band 242 until taut. When first engagement part 140 and second engagement part 150 are disengaged (e.g., referring to FIG. 8), and there is nothing impeding the path of drawer 110, the elastic band 242 may push drawer 110 in a direction toward open end 106*a* of second enclosure 106 (and away from closed end 106*b*). Elastic band 242 may include a rubber core and an outer cover (e.g., a cotton cover). The outer cover may function as a friction-reducing interface (e.g., may help reduce friction) between drawer 110 and second enclosure 106 during opening and closing.

Figure 12A:
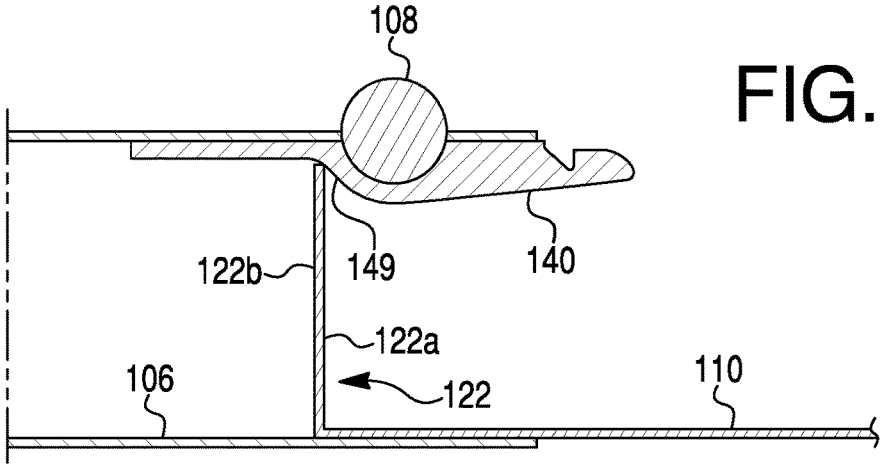
FIG. 12A is a partial side cross-sectional view of the packaging of FIGS. 1A and 1B.
Figure 12B:
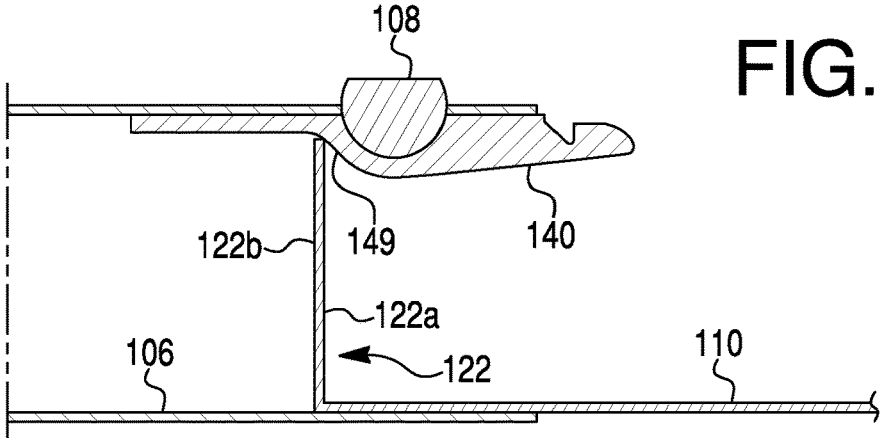
FIG. 12B is a partial side cross-sectional view of the packaging of FIGS. 2A and 2B.
Figure 12C:
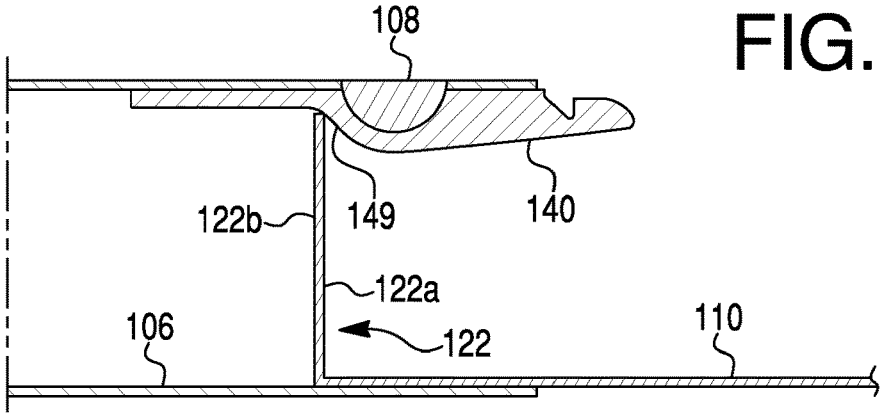
FIG. 12C is a partial side cross-sectional view of an alternative packaging.

Referring to FIGS. 12A-12C, first engagement part 140 may include a stop 149 that is configured to limit movement of drawer 110 when packaging 100 is in the open configuration. Stop 149 may be a portion of first engagement part 140 that extends toward base surface 120 of drawer 110. As drawer 110 moves from the closed configuration toward the open configuration, a sidewall 122 of drawer 110 may abut stop 149 when drawer 110 reaches its end range. Thus, the presence of stop 149 may help prevent drawer 110 from completely separating from second enclosure 106 in the open configuration. The sidewall 122 that abuts stop 149 may be the same sidewall 122 that pushes against elastic band 142 in the closed configuration shown in FIG. 11. However, referring to FIGS. 11 and 12A-12C, opposing sides of the sidewall 122 interact with stop 149 and elastic band 142, respectively. For example, an exterior side 122*b* of sidewall 122 may directly contact elastic band 142 in the closed configuration, while an interior side 122*a* of sidewall 122 may directly contact and abut stop 149. Interior side 122*a* may face toward open end 106*a* of second enclosure 106 and may be closer to open end 106*a* than exterior side 122*b*, which may face away from open end 106*a* and toward closed end 106*b*. Additionally, the friction between drawer 110 and second enclosure 106 may decrease the speed at which drawer 110 and second enclosure 106 may slide apart from one another.

Also depicted in FIGS. 12A-12C are various shapes and configurations for release button 108. In FIG. 12A, for example, a round (e.g. spherical) release button 108 is shown. In FIG. 12B, a flat-sided release button (e.g., a spherical cap), protruding from the surrounding second enclosure 106, is shown. In FIG. 12C (and FIG. 6B), a flat-sided release button that is substantially flush with the second enclosure 106 is shown. Other suitable shapes for release button 108, e.g., rectangular, irregular, star, ovular, or the like also are contemplated.

Referring back to FIG. 6A, the assembly process for packaging 100 may include nesting tray 124 within drawer 110, and attaching first engagement part 140 to an interior side of second enclosure 106. Release button 108 may be aligned with a perforated hole in a side (e.g., top side) of second enclosure 106. Second engagement part 150 then may be attached to an interior side of first enclosure 104. First enclosure 104 then may be secured to drawer 110 by a suitable adhesive mechanism, such as, e.g., glue, hot glue, or double-sided adhesive tape. Then, first end 244 and second end 246 of elastic band 242 may be attached to winglets on any pair of opposing and parallel sidewalls of second enclosure 106. Middle portion 248 of elastic band 242 may be slack at this juncture. Then, drawer 110 with the nested tray 124 and the attached first enclosure 104 may be pushed within a volume defined by second enclosure 106 until first engagement part 140 engages and locks with second engagement part 150, as shown in FIG. 7.

When packaging 100 is in the open configuration, a user may gain access to the contents stored therein (e.g., handle 2 and cartridges 14). Tray 124 may include various geometric features (or structural designs) to facilitate user ease of access to handle 2 and cartridges 14, and therefore enhance packaging ergonomics and other characteristics (e.g., accessibility, usability, user-friendliness, etc.). A user may close packaging 100 and secure the contents inside by pushing first enclosure 104 and second enclosure 106 together until first engagement part 140 engages and forms a lock with second engagement part 150. An audible click may be heard when first engagement part 140 engages second engagement part 150. Such an audible click may be incorporated into the cognitive ergonomics of packaging 100. The click may provide feedback when packaging 100 is opened and/or closed, and therefore may assist the user in functional comprehension of packaging 100. The overall dimensions of packaging 100 provide multiple grabbing points, making packaging 100 relatively easy to handle, such as when carried from a store shelve to the customer's basket, or when handed to a person as, e.g., a corporate gift. In this respect, one or more surfaces (e.g., side walls) of first enclosure 104 and/or second enclosure 106 may include suitable texturing to promote gripping of packaging 100 by a user.

An alternative biasing mechanism 1340 is shown in FIGS. 13-15. In this example, packaging 100 may be substantially the same as described above, except that instead of an elastic band 142, biasing mechanism 1340 may include a spring 1342 coupled to an inner surface of closed end 106*b* of second enclosure 106. Spring 1342 may be extended (i.e., in a relaxed configuration) in the open configuration of packaging 100 (see FIG. 14), and may be compressed by exterior side 122*b* of sidewall 122 in the closed configuration of packaging 100 (see FIG. 15). Thus, when packaging 100 is in the closed configuration, drawer 110 may push against and compress spring 1342. When first engagement part 140 and second engagement part 150 are disengaged (e.g., referring to FIG. 8), and there is nothing impeding the path of drawer 110, the potential energy stored in spring 1342 may push drawer 110 in a direction toward open end 106*a* of second enclosure 106 (and away from closed end 106*b*) as spring 1342 decompresses. While a single spring 1342 is shown, multiple springs 1342 coupled to closed end 106*b* may be used.

Yet another alternative biasing mechanism 1640 is shown in FIGS. 16-18. In this example, packaging 100 may be substantially the same as described above, except that instead of an elastic band 142 or spring 1342, biasing mechanism 1640 may include one or more first magnets

1602 (or magnetic stripes) and one or more second magnets 1604 (or magnetic stripes). First magnet 1602 may be coupled to an inner surface of closed end 106*b* of second enclosure 106, while second magnet 1604 may be coupled to exterior side 122*b* of sidewall 122. First and second magnets 1602 and 1604 may be arranged with like poles facing one another such that first and second magnets 1602, 1604 repel one another as they are brought closer together. For example, first and second magnets 1602 and 1604 may be arranged with their respective North poles facing one another, or their respective South poles facing one another. Thus, when packaging 100 is in the closed configuration, first and second magnets 1602 and 1604 experience the greatest repelling force against one another, and are held in close proximity due to the engagement of first engagement part 140 and second engagement part 150. When first engagement part 140 and second engagement part 150 are disengaged (e.g., referring to FIG. 8), and there is nothing impeding the path of drawer 110, the repelling force of first and second magnets 1602 and 1604 may push drawer 110 in a direction toward open end 106*a* of second enclosure 106 (and away from closed end 106*b*).

Figure 19:
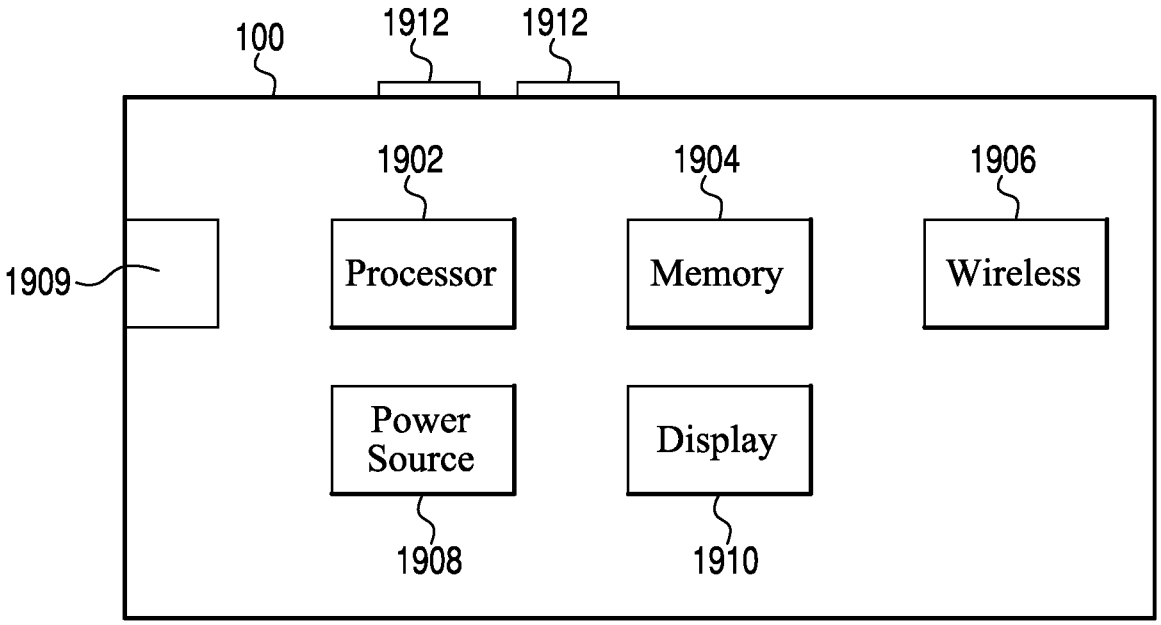
FIG. 19 is a schematic view of various components of the packaging of FIG. 1, according to an example of the present disclosure.

While in certain examples, it is envisioned that packaging 100 may be disposable, in other examples packaging 100 may be used as a storage case for shaver 10 and spare cartridges 14. Additionally, in some examples, packaging 100 may include one or more additional features configured to enhance the user's shaving experience. Referring to FIG. 19, packaging 100 may include a processor 1902, a memory 1904, and/or a wireless communication module 1906. In some aspects, packaging 100 may also include one or more sensors configured to detect the presence or absence of a cartridge 14 and/or handle 12, as described in greater detail below.

Data captured by sensors coupled to shaver 10, or by sensors on packaging 100, and stored in memory 1904 may be communicated to and analyzed by processor 1902. Processor 1902 may be equipped with software configured to analyze the received data to provide information to the user pertaining to the shaving experience. For example, processor 1902 may determine a usage of shaver 10, a shaving technique employed by the user, among other information. In one example, when processor 1902 determines that shaver 10 has exceeded a usage threshold, processor 1902 may generate an alert and/or automatically order replacement parts such as, e.g., a replacement cartridge 14.

As indicated above, processor 1902 may automate replacement ordering by contacting a merchant unit (not shown) with a communication via wireless communication module 1906, or may provide a prompt to the user via a display 1910 of packaging 100, or a display on a base or mobile phone or other smart device associated with shaver 10, within a certain period of time. For example, as processor 1902 determines that shaver 10 or cartridge 14 is approaching the end of its recommended useful life, processor 1902 may place or prompt an order for a replacement shaver and/or replacement cartridge. The replacement or prompting may also be based on accumulated user information, such as, for example, how often the user shaves and how many strokes the user uses during a given shaving session. This user information may assist processor 1902 in estimating when shaver 10 or cartridge 14 will reach the end of its recommended useful life, and thus order replacement parts for arrival at a user designated location and immediate availability to the user before shaver 10 or cartridge 14 reaches the end of its recommended useful life. The base or mobile application may also display or otherwise convey the accumulated user information. The aforementioned user information may also be used to provide recommendations to the user to, e.g., realize cost efficiencies by switching to another kind of cartridge 14 (e.g., with two blades instead of four blades), without sacrificing shave quality or comfort.

The data collected by the various sensors described herein may be transmitted to a manufacturer of shaver 10 to be used for further study and analysis. In some examples, the user may need to grant the manufacturer permission to collect this data.

Memory 1904 may be configured to store various shaving data collected by a sensor coupled to shaver 10, or one of the aforementioned sensors coupled to packaging 100, over time. The information stored in memory 1904 may be obtained via any suitable mechanism now known or later developed. For example, information collected by sensors coupled to shaver 10 may be transmitted by wired connection, a docking connection, or a wireless connection (e.g., via wireless communication module 1906 described in further detail below).

Wireless communication module 1906 may be configured to receive and/or transmit information over one or more wireless modalities, such as, e.g., Bluetooth, Bluetooth low energy (BLE), infrared, cellular networks, and wireless networks, among others. In one example, wireless communication module 1906 may receive shaving data collected by shaver 10, for storage in memory 1904 and analysis by processor 1902. In some examples, packaging 100 may be configured to use multiple wireless modalities, including, e.g., Bluetooth, cellular, and wireless networks.

Power source 1908 may be configured to provide power to the other various electronic components of packaging 100, and may, for example, be a battery chargeable by any suitable mechanism, including, e.g., an AC plug, a USB plug, inductive or wireless charging methods or the like. In one example, a port 1909 may be a USB port configured to provide both power for components of packaging 100, as well as to provide a connection for downloading data from memory 1904. In other examples, the power source 1908 may be a replaceable disposable battery (e.g., a coin cell or AAA battery). In some examples, shaver compartment 126 may include electrical contacts and may act as a recharging base coupled to port 1909 and/or power source 1908 for charging shaver 10. In other examples, shaver 10 may be placed in shaver compartment 126 to be inductively or wirelessly recharged. Thus, packaging 100 may be used as a base station for charging a shaver 10 via wired power sources, and may also be used as a portable charging station by drawing stored energy from power source 1908. In some examples, charging may be initiated only when packaging 100 is in the closed configuration to ensure that shaver 10 is secured within packaging 100 before charging. In at least one example, a sensor or switch may be configured to sense that packaging 100 is closed and processor 1902 may be configured to prevent a charging operation unless the sensor or switch indicates the closed configuration.

Display 1910 may be, e.g., a screen, LED, series of LEDs, or the like that is/are configured to convey various information relating to packaging 100 and/or shaver 10. In one example, display 1910 may display a charging status of shaver 10 and/or an estimation of stored energy remaining in power source 1908. When display 1910 is a screen, information relating to data collected from shaver 10, and/or analysis and recommendations from processor 1902 may be displayed.

Packaging 100 may also include one or more input devices 1912 (e.g., buttons) on an outer surface of packaging 100, and/or contained within packaging 100. Input devices 1912 may be configured to, for example, initiate a charging cycle, or cause display 1910 to present various information. In yet another example, input device 1912 may be used to initiate an order for a new shaver 10 or replacement cartridge 14 from a merchant. For example, actuation of input device 1912 may cause processor 1902 to contact a merchant unit and place an order.

As alluded to above, packaging 100 may also include one or more sensors (not shown) configured to detect the presence or absence of a cartridge 14 and/or handle 12. Such sensors may be configured to track the number of times handle 12 is removed and/or replaced within tray 124. Moreover, such sensors may also be configured to detect the presence of replacement cartridges 14 in compartments 128. When each compartment 128 is empty, or a majority of compartments 128 are empty, such information may be communication to processor 902, which, in turn, may initiate an order for additional replacement cartridges 14.

All technical and scientific terms used herein have the same meaning as commonly understood to one of ordinary skill in the art to which this disclosure belongs unless clearly indicated otherwise. As used herein, the singular forms "a", "an", and "the" include plural references unless the context clearly dictates otherwise. Thus, for example, reference to "a sensor" may include a plurality of such sensors and reference to "the sensor" may include reference to one or more sensors and equivalents thereof known to those skilled in the art, and so forth.

The above description is illustrative, and is not intended to be restrictive. One of ordinary skill in the art may make numerous modifications and/or changes without departing from the general scope of the disclosure. For example, and as has been described, the above-described embodiments (and/or aspects thereof) may be used in combination with each other. Additionally, portions of the above-described embodiments may be removed without departing from the scope of the disclosure. In addition, modifications may be made to adapt a particular situation or material to the teachings of the various embodiments without departing from their scope. Many other embodiments will also be apparent to those of skill in the art upon reviewing the above description.

What is claimed is:

1. A packaging for a shaver, comprising:
a shell and a drawer disposed within the shell;
the shell including a first enclosure and a second enclosure, and an actuator disposed on an outer surface of the first enclosure;
the actuator being configured to shift the first enclosure and the second enclosure relative to one another between a closed configuration and an open configuration;
the first enclosure and the second enclosure are in direct contact with one another in the closed configuration; and in the open configuration, are connected by the drawer and are not in direct contact with one another.

2. The packaging of claim 1, further including a biasing mechanism configured to bias the shell into the open configuration.

3. The packaging of claim 1, wherein the actuator includes a sphere extending away from an outer surface of the shell, a spherical cap extending away from the outer surface of the shell, or a button having a top surface that is flush with the outer surface of the shell.

4. The packaging of claim 1, wherein the drawer is fixed to the first enclosure, and movable relative to the second enclosure.

5. The packaging of claim 1, further including a stop configured to abut a sidewall of the drawer to prevent the drawer from separating from the second enclosure in the open configuration.

6. The packaging of claim 5, further including a biasing mechanism configured to bias the shell into the open configuration, wherein:
the stop is configured to abut an interior side of the sidewall of the drawer;
an exterior side of the sidewall of the drawer pushes against the biasing mechanism in the closed configuration;
the stop is part of a first engagement mechanism coupled to a surface of the first enclosure;
the packaging further including a second engagement mechanism coupled to a surface of the second enclosure; and
the first engagement mechanism and the second engagement mechanism are interlocked with one another in the closed configuration.

7. The packaging of claim 1, wherein the second enclosure includes opposing sidewalls, and the system further includes a biasing mechanism with a band coupled at first and second ends to opposing sidewalls of the second enclosure, wherein:
in the closed configuration, the drawer pushes against the band, causing the band to be taut; and
in the open configuration, the band is slack.

8. The packaging of claim 1, wherein the second enclosure extends from a closed end to an open end, the drawer being slidable through the open end, and the packaging further includes a biasing mechanism including a spring attached to the closed end of the second enclosure, the spring being extended in the open configuration, and configured to be compressed by the drawer in the closed configuration.

9. The packaging of claim 1, wherein the second enclosure extends from a closed end to an open end, the drawer being slidable through the open end, and the packaging further includes a biasing mechanism including a first magnet coupled to the closed end of the second enclosure, and a second magnet coupled to the drawer, wherein like poles of the first magnet and the second magnet face one another.

10. The packaging of claim 1, wherein an outer surface of the shell includes an image of the shaver with an image of a cartridge being disposed on the first enclosure and an image of a handle being disposed on the second enclosure.

11. The packaging of claim 10, wherein the image of the handle includes a proximal end and a distal end, the actuator being disposed at the proximal end of the image of the handle and being positioned such that a center of the actuator is configured to correspond with a center of a release button of the shaver.

12. The packaging of claim 10, wherein the image is embossed and/or engraved in the outer surface of the shell.

13. The packaging of claim 1, further including a pair of engagement members that interlock with one another to maintain the shell in the closed configuration, wherein activation of the actuator causes one of the pair of engagement members release from the interlock.

14. The packaging of claim 1, further including a tray contained within the shell, the tray including a plurality of storage compartments.

15. A package, comprising:
a drawer;

a shell surrounding the drawer, the shell having a first enclosure and a second enclosure, the shell being configured to shift between a closed configuration where the first enclosure and the second enclosure are proximate to one another, and an open configuration where the first enclosure and the second enclosure are separated from one another;

an actuator coupled to the outer surface of shell; and a biasing mechanism configured to bias the shell into the open configuration such that activation of the actuator while the shell is in the closed configuration causes the biasing mechanism to apply a force against the drawer to shift the shell into the open configuration.

16. The package of claim 15, wherein the drawer is fixed to the first enclosure, and movable relative to the second enclosure.

17. A method of opening and closing a shaving system; the shaving system including a shell and a shaver; the shell including a first enclosure, a second enclosure, a drawer and an actuator; the first enclosure and the second enclosure being configured to shift between a closed configuration and an open configuration; the shaver being disposed in the drawer of the shell and including a handle, a cartridge containing one or more blades, and a release mechanism for decoupling the cartridge from the handle; the method comprising:

providing the actuator on an outer surface of the shell;

arranging the shaver within the drawer of the shell such that the actuator is positioned to correspond with the release mechanism of the shaver;

applying a force against the actuator, while the shell is in the closed configuration, and causing the first enclosure and the second enclosure to shift away from one another toward the open configuration, wherein the first enclosure and the second enclosure are in direct contact in the closed configuration, and are connected by the drawer and not in direct contact with one another while in the open configuration.

18. The method of claim 17, further including the steps of providing a biasing mechanism, the biasing mechanism applying a force against the drawer and shifting the shell into the open configuration.

* * * * *